US007419197B1

(12) United States Patent
Leith

(10) Patent No.: US 7,419,197 B1
(45) Date of Patent: Sep. 2, 2008

(54) PORTABLE SECURITY LOCK FOR DOORS

(76) Inventor: Thomas Leith, 612 Taran Ct., Frederick, MD (US) 21703

( * ) Notice: Subject to any disclaimer, the term of this patent is extended or adjusted under 35 U.S.C. 154(b) by 95 days.

(21) Appl. No.: 11/249,694

(22) Filed: Oct. 13, 2005

(51) Int. Cl.
*E05C 19/18* (2006.01)

(52) U.S. Cl. ..... 292/291; 292/288; 292/289

(58) Field of Classification Search ..... 292/291, 292/288, 289, 293, 294, 346
See application file for complete search history.

(56) References Cited

U.S. PATENT DOCUMENTS

| | | | | | |
|---|---|---|---|---|---|
| 359,815 | A | * | 3/1887 | Sargent | 292/291 |
| 1,888,425 | A | * | 11/1932 | Dowling | 292/291 |
| 2,288,022 | A | * | 6/1942 | O'Brien et al. | 292/291 |
| 3,589,761 | A | | 6/1971 | Lambert | |
| 4,103,524 | A | | 8/1978 | Mitchell et al. | |
| 4,285,535 | A | | 8/1981 | Leary | |
| 4,304,110 | A | | 12/1981 | Fain | |
| 4,387,919 | A | | 6/1983 | Quaintance | |
| 4,529,351 | A | * | 7/1985 | Olins | 414/545 |
| D316,026 | S | | 4/1991 | Fuller | |
| 5,095,723 | A | | 3/1992 | Lin | |
| D331,870 | S | | 12/1992 | Fuller | |
| 5,203,187 | A | | 4/1993 | Kane | |
| 5,221,116 | A | * | 6/1993 | Lan | 292/291 |
| D348,824 | S | | 7/1994 | Hsu | |
| 5,325,685 | A | | 7/1994 | Frank | |
| D349,839 | S | | 8/1994 | Gilardelli | |
| D349,840 | S | | 8/1994 | Fuller | |
| D350,472 | S | | 9/1994 | White et al. | |
| D362,172 | S | | 9/1995 | Lo | |
| D369,738 | S | | 5/1996 | Hull, Jr. et al. | |
| D370,616 | S | | 6/1996 | Fard | |
| 5,810,414 | A | | 9/1998 | Choquet | |
| 5,924,751 | A | | 7/1999 | Moore | |
| D412,826 | S | | 8/1999 | Calpito | |
| 6,136,642 | A | | 10/2000 | Tan et al. | |

* cited by examiner

*Primary Examiner*—Patricia Engle
*Assistant Examiner*—Mark Williams

(57) ABSTRACT

A door securing apparatus is disclosed for securing a door in a closed position in a door frame. The apparatus includes an anchor member for removably securing to a portion of the door frame, with at least a portion of the anchor member being positionable between the door and the door frame. The apparatus also includes a pressure assembly configured to engage the anchor member and press against the door and the door frame.

1 Claim, 4 Drawing Sheets

PORTABLE SECURITY LOCK FOR DOORS

RELATED DATA

The subject matter of the present utility patent application has been registered with the United States Patent and Trademark Office under the disclosure document program. The request was received at the United States Patent and Trademark Office on Feb. 9, 2004 and was assigned the registration number 546,488. Previous to that, a request was submitted to the United States Patent and Trademark Office on Mar. 11, 2002 and was assigned the registration number 507,236.

BACKGROUND OF THE INVENTION

1. Field of the Invention

The present invention relates to door securing apparatus and more particularly pertains to a new security lock for securing a door in the door's frame that is easily movable between doors and does not require special mounting or damage to the door.

2. Description of the Prior Art

Many door securing apparatus have been proposed in the art, but the numerous approaches that have been proposed have drawbacks that limit the portability of these devices between different doors, the ability of these devices to be adapted to different door and door frame configurations, and the ease of use of these devices. In particular, the known devices typically bear on the door or the door frame, but not both. Further, the known devices have limited ability to engage the surfaces of the door or the door frame, particularly where the door frame is angled with respect to the plane of the face of the door, or where the door frame protrudes a significant distance from the plane of the door.

For a door security apparatus to truly be secure, and truly be portable between different doors, the apparatus needs to be capable of bearing on both the door and the door frame, and needs to be capable of effectively bearing on various styles and configurations of door frames. It is believed that there is a need for a door securing apparatus that satisfies both of these goals.

SUMMARY OF THE INVENTION

In view of the foregoing disadvantages inherent in the known types of door securing apparatus now present in the prior art, the present invention provides a new portable security lock for doors construction wherein the same can be utilized for securing a door in the door's frame that is easily movable between doors and does not require special mounting or damage to the door.

To attain this, the present invention generally comprises a door securing apparatus for securing a door in a closed position in a door frame. The apparatus includes an anchor member for removably securing to a portion of the door frame, with at least a portion of the anchor member being positionable between the door and the door frame. The apparatus also includes a pressure assembly configured to engage the anchor member and press against the door and the door frame.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the ability to easily adjust to different door and door frame thicknesses and configurations, making the apparatus easily transferable between different door and door frame applications. The present invention bears on both the door and the door frame, so that it is also able to secure the door against rattling movement with respect to the door frame, which can be a problem in hotels with hallways that have a number of doors and foot traffic.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
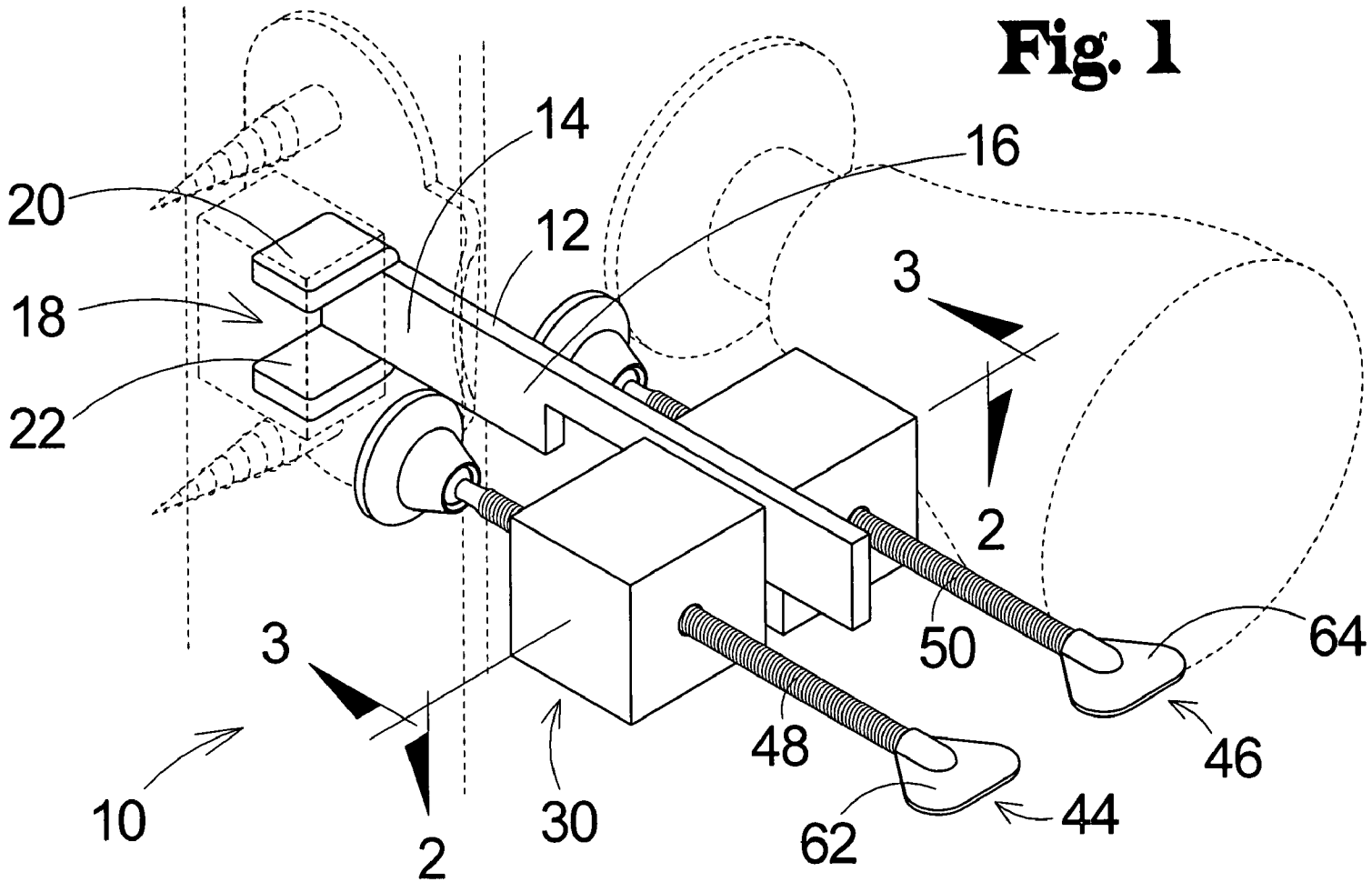
FIG. 1 is a schematic perspective view of the portable security lock of the present invention in a removably mounted condition on a door and door frame shown in broken lines.
Figure 2:
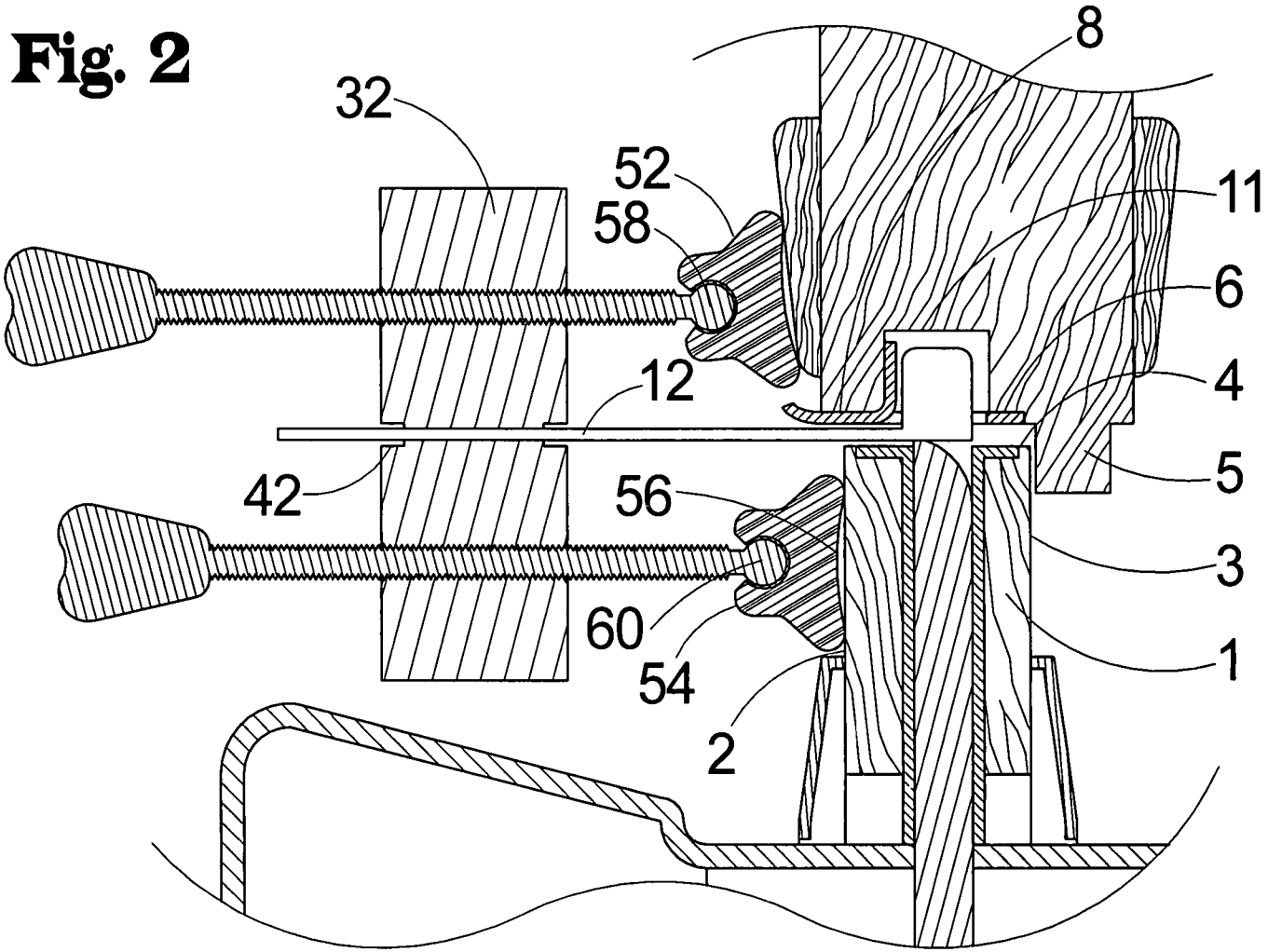
FIG. 2 is a schematic top sectional view of the present invention.
Figure 3:
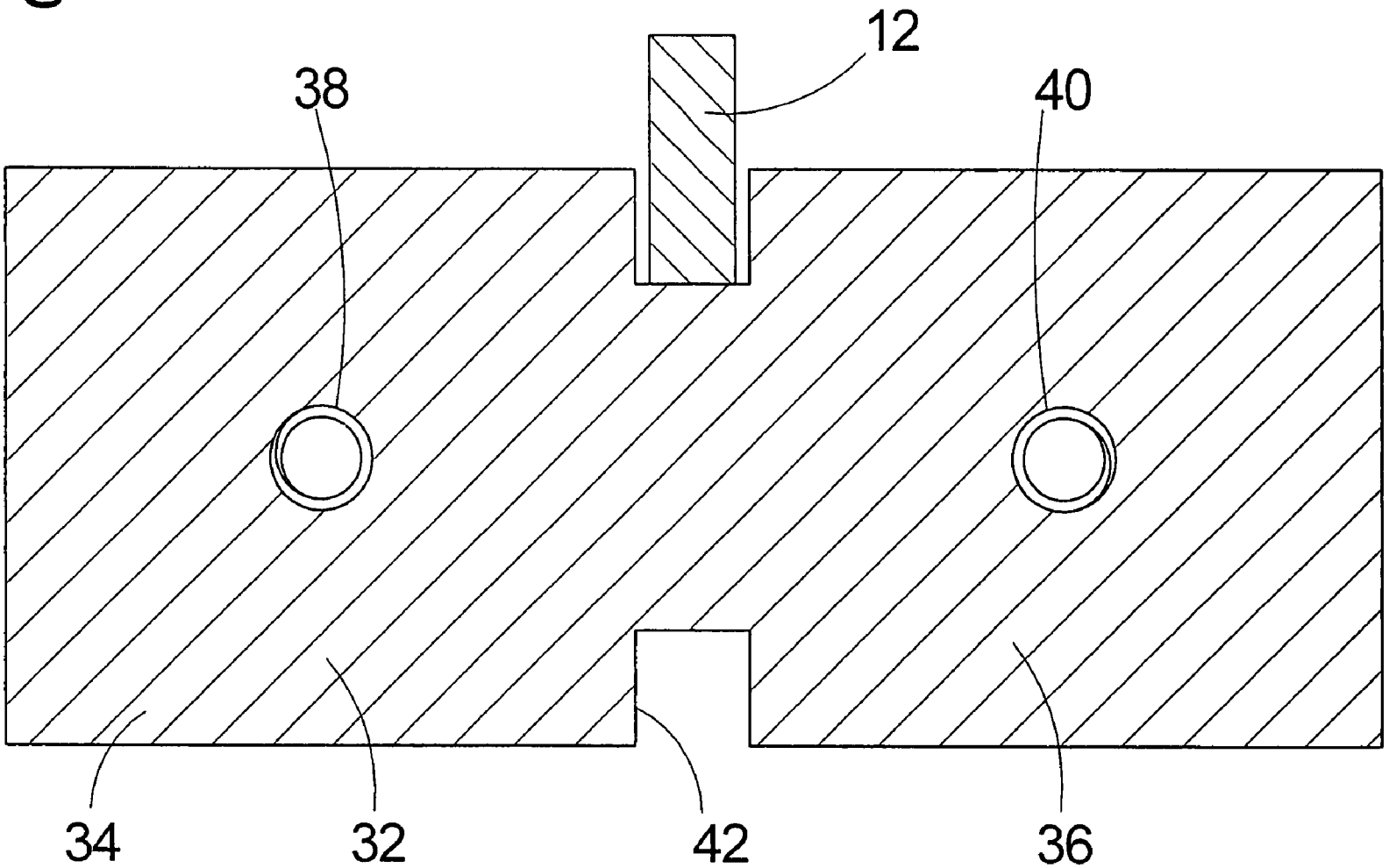
FIG. 3 is a schematic transverse sectional view of the present invention.
Figure 4:
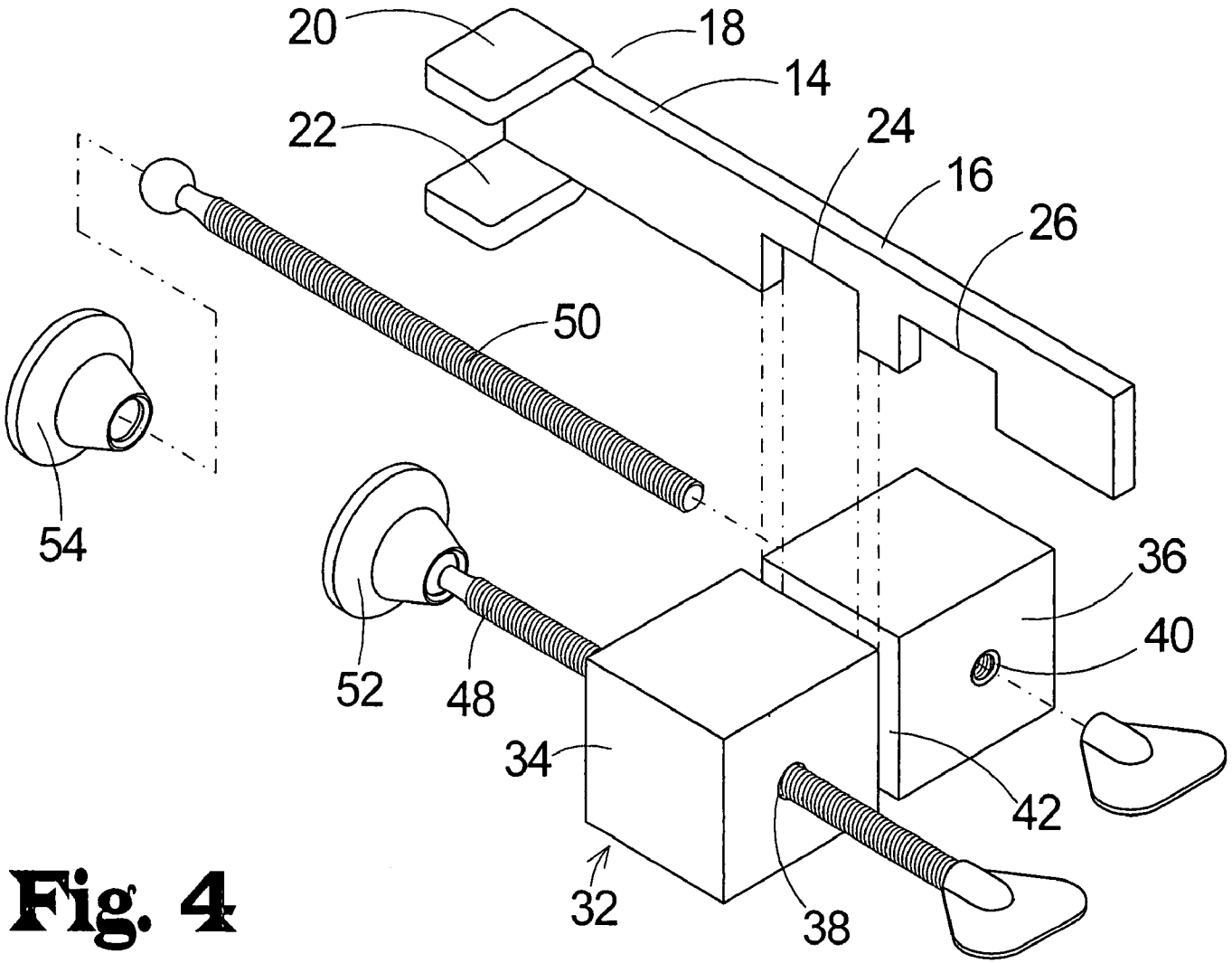
FIG. 4 is a schematic perspective exploded view of the present invention.

With reference now to the drawings, and in particular to FIGS. 1 through 4 thereof, a new portable security lock for doors embodying the principles and concepts of the present invention and generally designated by the reference numeral 10 will be described.

As best illustrated in FIGS. 1 through 4, the portable door securing apparatus 10 generally comprises an anchor member 12 for removably securing to a portion of the door and frame and a pressure assembly 30 for engaging the anchor member 12 and pressing against the door and the door frame.

The door securing apparatus 10 of the invention is highly suitable for securing a door 1 in a closed position with respect to as door frame 5 on which the door is pivotally mounted by one or more hinges. For ease of the following description of the invention and how it relates to other elements in use, it is noted that the door 1 typically has a first face 2, second face 3 that is oriented oppositely of the first face 2, and a perimeter edge surface 4 that extends about the door and between the first 2 and second 3 faces. The door frame 5, which is sometimes referred to as the door jamb, has an inward surface 6 with a hinge side section where one or more hinges are typically located, a strike side section 8 where the door strike or latch components are located, and an upper section that extends between the hinge side section 7 and the strike side section 8. The strike side section 8 of the door frame 5 commonly includes a cavity 11 that extends into a surface of the strike side section for receiving the end portion of the door latch, or the end portion of a deadbolt, that extends from the perimeter edge surface of the door.

The door securing apparatus includes the anchor member 12 that is removably securable to a portion of the door frame 5, and is typically attached to the strike side section 7. At least a portion of the anchor member 12 is positionable between the door 1 and the door frame 5 when the door is in a closed position or condition, and may be initially positioned alongside the strike side section 7 of the door frame, and the door 1 is then closed with the anchor member remaining in that position, and the perimeter edge face 4 may act to hold the anchor member in that position, at least initially, although the door is not required to hold the anchor member in place.

In general, the anchor member 12 of the invention may include an insertion portion 14 for positioning between the door 1 and the door frame 5, an extension portion 16 for extending outwardly from between the door and frame when the insertion portion 14 is positioned between the door and frame, and a door frame engaging portion 18 for engaging a portion of the door frame at a location between the door and the door frame. The anchor member 12 may generally be elongate in character, with a longitudinal axis extending between opposite ends of the member.

In greater detail, the door frame engaging portion 18 may be located on the insertion portion 14 of the anchor member 12. The door frame engaging portion 18 is insertable into the cavity 11 of the strike side section 8 of the door frame 5. In one embodiment of the invention, the door frame engaging portion 18 comprises at least one finger 20 that extends from the insertion portion 14, and in some highly effective embodiments of the invention the door frame engaging portion includes a pair of fingers 20, 22 that extend from the insertion portion 14. The fingers 20, 22 may extend substantially perpendicular to the insertion portion 14, and the fingers may be laterally spaced from each other with respect to the longitudinal axis of the anchor member.

The extension portion 16 may have at least one engaging notch 24 which is longitudinally spaced or separated from the insertion portion 14. In some highly preferred embodiments of the invention, the extension portion 16 has a pair of engaging notches 24, 26, with a first one 24 of the engaging notches being relatively closer to the insertion portion 14 than a second one 26 of the engaging notches. More specifically, the notches 24, 26 in the extension portion may be formed by a reduced width section of the extension portion located between relatively wider sections of the extension portion or the insertion portion.

In the illustrative embodiment of the invention, each of the engaging notches 24, 26 is substantially rectangular in shape, although those skilled in the art will recognize that the shape of the notch may be varied from the disclosed shape.

The pressure assembly 30 of the invention engages the anchor member 12 and presses against one of the faces 2, 3 of the door as well as a surface on the door frame that may be substantially perpendicular to the strike side section of the frame, but that orientation is not critical to the proper functioning of the invention.

The pressure assembly 30 may comprise a main member 32 that is removably mounted or mountable on the anchor member 12. In general, the pressure assembly includes means for engaging the anchor member 12 in a secure but removable manner, and also means for applying biasing pressure against areas of the door and door frame located adjacent to the anchor member. The main member 32 has a pair of end portions 34, 36 that may be integrally connected together. The main member 32 may be generally elongated in shape, with each of the end portions being located at opposite ends of the main member.

In some embodiments of the main member 32, a bore extends 38, 40 through each of the end portions 34, 36 of the member 32. The bores 38, 40 may have a threaded interior surface for a purpose described further below. The main member 32 may have a groove 42 formed therein for receiving a portion of the extension portion 16 of the anchor member 12 about the engaging notch 24, 26. The groove 42 may be located between the end portions 34, 36, and may extend about a lateral perimeter of the main member, which can facilitate the use of the apparatus 10 on both right-hand opening and left-hand opening doors, although this feature is not critical for sue flexibility.

The pressure assembly 30 may also include a pair of adjustable pressure members 44, 46 that are mounted on the main member 32 in a manner such that the pressure members extend from the main member to be adjusted to simultaneously engage the door and the door frame in a pressing abutment. Significantly, the extension of the pressure members 44, 46 from the main member 32 is adjustable in nature, so that the pressure members can be moved closer to and further from the door and door frame.

Each of the pressure members 44, 46 may comprise a post 48, 50 that is mounted on one of the end portions 34, 36 of the main member 32. The post 48, 50 extends through one of the bores 38, 40 of the main member 32. The post 48, 50 may have a threaded exterior for threadably engaging the threaded interior surface of the bore, so that rotating the post in one rotational direction moves the post toward the door and door frame in use, and rotating the post in the other rotational direction moves the post away from the door and door frame.

Each of the pressure members 44, 46 may further comprise an abutment cup 52, 54 that is mounted on the respective post 48, 50. The abutment cup 52, 54 may be located on an end of the post 48, 50 such that advancement of the post toward the door and door frame brings the abutment cup into contact with the door and frame. Preferable, but not critically, the abutment cup 52, 54 may be formed of an material that provides a degree of resilient compressibility such as, for example, an elastomeric material. The abutment cup 52, 54 may also has a concave abutment face 56.

Each of the pressure members 44, 46 may also comprise an abutment joint 58, 60 that is located on the respective post 48, 50 in a location substantially adjacent to the abutment cup 52, 54. Optionally, the abutment joint 58, 60 may comprise a ball and socket type joint that permits some degree of orientation adjustment by the abutment cup 52, 54. In other embodiments, the joint 58, 60 may have a hexagonal perimeter and may provide a mounting point for the abutment cup on the end of the post.

Each of the pressure members 44, 46 may further comprise an adjustment handle 62, 64 that is mounted on the respective post 48, 50. The adjustment handle 62, 64 may be mounted on an end of the post that is located opposite of the abutment cup 52, 54. The adjustment handle 62, 64 may comprise a pair of wings, similar to a wing nut, to enhance the user's ability to apply torque to the post when snugging the abutment cup against the door and door frame.

The invention thus also contemplates a method of securing a door from opening out of a door frame using the door securing apparatus 10 of the invention. Use of the apparatus may thus include opening the door 1 from the door frame 5, positioning the door frame engaging portion 18 of the anchor member 12 in the cavity 11 located in the strike side section 8 of the door frame 5. The method may further include closing the door 1 with the insertion portion 14 of the anchor member 12 located between the door 1 and the strike side section 8 of the door frame 5, and positioning the extension portion 16 to extend outwardly from the door and door frame.

The method may further include engaging the main member 32 on the anchor member 12, which may comprise hooking the anchor member onto the main member, and may include inserting the main member 32 into one of the notches 24, 26 of the anchor member such that a portion of the anchor member extends into the groove 42 of the main member.

The method may further include extending a first one of the pressure members 44, 46 from the main member 32 such that the abutment cup 52 of the first pressure member 44 abuts the door and extending a second one of the pressure members from the main member such that the abutment cup 54 of the second pressure member 46 abuts the door frame. The abutment cups are snugged up against the door and door frame until movement of the door with respect to the door frame engaged by the anchor member is restricted by the cups. The pressure members 44, 46 may be adjusted individually of each other, so that, for example, a door frame that protrudes a significant distance with respect to the first face of the door is readily accommodated.

In the illustrative embodiment of the invention, the insertion portion 14 and the extension portion 16 of the anchor member 12 are formed by an elongated plate, which may have a substantially uniform thickness along the length of the plate, and may have a generally uniform width with the exception of the locations of the notches and as noted herein. For example, a section of the insertion portion 14 may have a reduced width as compared to the width of the extension portion 16.

Optionally, the anchor member 12 may be magnetized to attract to the main member 32. The anchor member 12 may be formed out of a metal, although other sufficiently rigid and strong materials, such as high strength plastics or composites, may also be employed for the anchor member.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Index of Elements for PORTABLE SECURITY LOCK FOR DOORS

| | |
|---|---|
| 1. | door |
| 2. | first face of door |
| 3. | second face of door |
| 4. | perimeter edge face of door |
| 5. | door frame |
| 6. | inward surface of door frame |
| 7. | |
| 8. | strike side section of inward surface |
| 9. | |
| 10. | door securing apparatus |
| 11. | cavity in door frame |
| 12. | anchor member |
| 13. | |
| 14. | insertion portion of the anchor member |
| 15. | |
| 16. | extension portion of member 12 |
| 17. | |
| 18. | door frame engaging portion of mbr 12 |
| 19. | |
| 20. | (first) finger of D/F/E/P |
| 21. | |
| 22. | (second) finger of D/F/E/P |
| 23. | |
| 24. | (first) engaging notch |
| 25. | |
| 26. | (second) engaging notch |
| 27. | |
| 28. | |
| 29. | |
| 30. | pressure assembly |
| 31. | |
| 32. | main member |
| 33. | |
| 34. | (first) end portion |
| 35. | |
| 36. | (second) end portion |
| 37. | |
| 38. | (first) bore |
| 39. | |
| 40. | (second) bore |
| 41. | |
| 42. | groove |
| 43. | |
| 44. | (first) adjustable pressure member |
| 45. | |
| 46. | (second) adjustable pressure member |
| 47. | |
| 48. | (first) post |
| 49. | |
| 50. | (second) post |
| 51. | |
| 52. | (first) abutment cup |
| 53. | |
| 54. | (second) abutment cup |
| 55. | |
| 56. | concave abutment face |
| 57. | |
| 58. | (first) abutment nut |
| 59. | |
| 60. | (second) abutment nut |
| 61. | |
| 62. | (first) adjustment handle |
| 63. | |
| 64. | (second) adjustment handle |
| 65. | |
| 66. | |
| 67. | |
| 68. | |
| 69. | |
| 70. | |
| 71. | |
| 72. | |
| 73. | |
| 74. | |
| 75. | |
| 76. | |
| 77. | |

-continued

| Index of Elements for PORTABLE SECURITY LOCK FOR DOORS |
|---|
| 78. |
| 79. |
| 80. |

I claim:

1. A door securing apparatus for securing a door in a closed position in a door frame, the apparatus comprising:

an anchor member for removably securing to a portion of the door frame, at least a portion of the anchor member being positionable between the door and the door frame;

a pressure assembly configured to engage the anchor member and press against the door and the door frame;

wherein the pressure assembly comprises a main member removably mounted on the anchor member and a pair of adjustable pressure members mounted on the main member such that the pressure members extend from the main member to simultaneously engage the door and the door frame, wherein extension of the pressure members from the main member is adjustable; and wherein the main member has an upper surface with a groove configured to receive a portion of the anchor member when the anchor member is rested on the upper surface, the anchor member having at least one engaging notch configured to receive a portion of the main member such that the at least one engaging notch of the anchor member and the groove of the main member interlock when the anchor member is rested on the upper surface of the main member;

wherein the main member has a pair of end portions integrally connected together, a bore extending through each of the end portions of the member;

wherein each of the pressure members comprises a post mounted on the main member and an abutment cup mounted on the post, the post extending through a bore of the main member;

wherein the abutment cup is formed of an elastomeric material;

wherein the abutment cup has a concave abutment face;

wherein the abutment cup is swivelable with respect to the post;

wherein each of the pressure members includes an adjustment handle mounted on an end of the post opposite of the abutment cup;

wherein the anchor member includes an insertion portion for positioning between the door and the door frame, an extension portion for extending outwardly from between the door and the door frame when the insertion portion is positioned between the door and the door frame, and a door frame engaging portion for engaging a portion of the door frame between the door and the door frame;

wherein the door frame engaging portion is located on the insertion portion, the door frame engaging portion being insertable into the cavity of the strike side section of the door frame;

wherein the extension portion has a pair of engaging notches for receiving a portion of the pressure assembly, a first one of the engaging notches being relatively closer to the insertion portion than a second one of the engaging notches;

wherein the door frame engaging portion comprises a pair of fingers, the fingers being spaced from each other along an axis oriented substantially transverse to a longitudinal axis of the anchor member;

wherein each of the spaced fingers comprises a plate, the spaced plates being oriented substantially parallel to each other;

wherein the at least one finger extends substantially perpendicular to the insertion portion;

wherein the main member has opposite side surfaces positioned one opposite sides of the upper surface of the main member, the groove being formed in each of the side surfaces of the main member, at least a portion of the anchor member being received in the groove in the side surfaces when the anchor member is rested on the upper surface of the main member;

wherein the groove extends from a first one of the opposite sides to a second one of the opposite sides of the main member;

wherein the groove extends into the upper surface of the main member; and wherein the groove extends substantially continuously around an entirety of the main member.

* * * * *